United States Patent [19]

Lesley

[11] Patent Number: 4,813,161

[45] Date of Patent: Mar. 21, 1989

[54] FOOTWEAR

[75] Inventor: Bascum G. Lesley, Pickens, S.C.

[73] Assignee: Milliken Research Corporation, Spartanburg, S.C.

[21] Appl. No.: 694,476

[22] Filed: Jan. 23, 1985

Related U.S. Application Data

[63] Continuation of Ser. No. 605,178, Apr. 30, 1984, abandoned.

[51] Int. Cl.[4] ..... A43B 13/40

[52] U.S. Cl. ..... 36/44

[58] Field of Search ..... 36/28, 29, 43, 44

[56] References Cited

U.S. PATENT DOCUMENTS

| | | | |
|---|---|---|---|
| 895,950 | 8/1908 | Von Bracht | 36/44 |
| 1,659,339 | 2/1928 | Vetterling | 36/29 |
| 2,237,190 | 4/1941 | McLeod | 36/29 |
| 2,677,906 | 5/1954 | Reed | 36/28 |
| 2,728,999 | 1/1956 | Hollier | 36/28 |
| 3,914,881 | 10/1975 | Striegel | 36/29 |
| 4,005,532 | 2/1977 | Giese | 36/44 |
| 4,043,058 | 8/1977 | Hollister et al. | 36/28 |
| 4,073,072 | 2/1978 | Gross et al. | 36/44 |
| 4,123,855 | 11/1978 | Thedford | 36/29 |
| 4,219,945 | 9/1980 | Rudy | 36/29 |
| 4,227,320 | 10/1980 | Borgeas | 36/29 |
| 4,280,342 | 7/1981 | Eng et al. | 66/196 |
| 4,297,796 | 11/1981 | Stirtz et al. | 36/28 |
| 4,297,797 | 11/1981 | Meyers | 36/29 |
| 4,319,412 | 3/1982 | Muller | 36/29 |
| 4,356,642 | 11/1982 | Herman | 36/44 |

FOREIGN PATENT DOCUMENTS

| | | | |
|---|---|---|---|
| 2855268 | 7/1980 | Fed. Rep. of Germany | 36/29 |
| 3225550 | 1/1984 | Fed. Rep. of Germany | 36/43 |
| 47908 | 8/1978 | Switzerland | 36/43 |
| 385060 | 7/1932 | United Kingdom | 36/29 |

*Primary Examiner*—Werner H. Schroeder

*Attorney, Agent, or Firm*—Earle R. Marden; H. William Petry

[57] ABSTRACT

A double plush pile fabric for use in shoe construction which will cushion the pressure exerted on the foot as the person wearing the shoe walks or runs in normal manner.

4 Claims, 1 Drawing Sheet

FOOTWEAR

This is a continuation of application Ser. No. 605,178, filed Apr. 30, 1984, now abandoned.

Man, for generations, has had problems with his feet due to the constant pounding of hard surfaces encountered in everyday walking activities. This is accelerated particularly in sports activities whether it be a real active sport such as basketball or a less active sport such as running or jogging. Various types of shoe construction and inserts have been tried but none have been completely successful in absorbing the constant pounding encountered in any particular activity and heat build up due to the non-porous construction of the shoe.

Therefore, it is an object of the invention to provide a new and improved footwear which will greatly relieve the stress placed on the foot during normal or abnormal daily activities.

Other objects and advantages of the invention will be readily apparent as the specification proceeds to describe the invention with reference to the accompanying drawings, in which.

Figure 1:
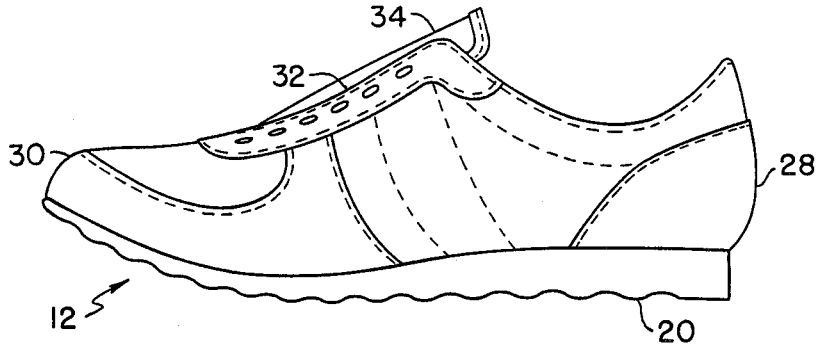
FIG. 1 is a side elevation of an athletic shoe type.
Figure 2:
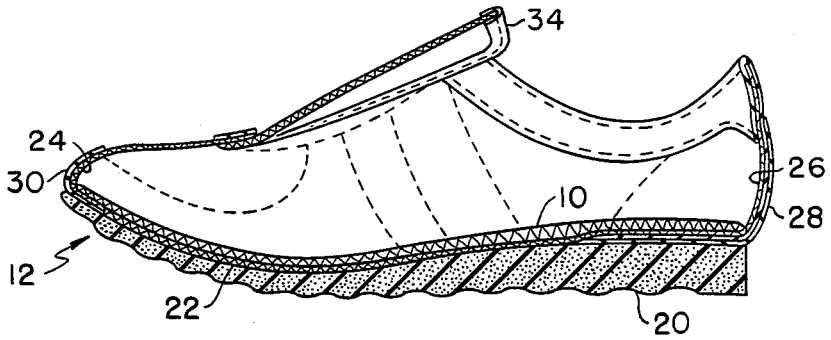
FIG. 2 is a section view through the shoe shown in FIG. 1.
Figure 3:
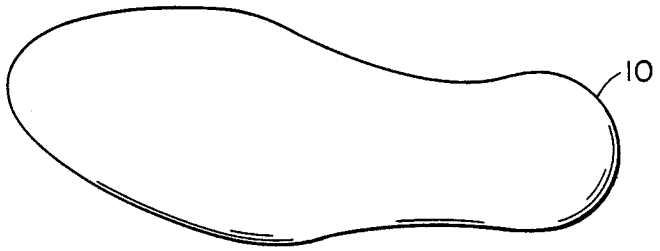
FIG. 3 is a bottom view of a stress relieving shoe sole support member.
Figure 4:
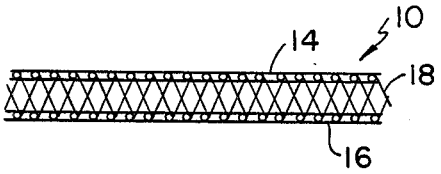
FIG. 4 is schematic cross-sectional view of a new shoe sole inlay product.

In the preferred form of the invention, the double plush fabric 10 is shown in use with an athletic shoe 12 but obviously the type of shoe is not, per se, part of the invention. The double plush fabric 10 is made on a double needle bar warp knitting machine with the base fabric 14 being made on the front needle bar by the front guide bars and a separate base fabric 16 being knit on the back guide bars thereby producing two separate fabrics which are jointed together by pile yarns 18 mounted on the center guide bar and which lap on both needle bars so that the pile yarn connecting the two fabrics together. This is a commercially available fabric and distance between the base fabrics 14 and 16 can be as much as 140mm depending on the distance between the needle bars. This fabric is relatively elastic and porous to provide flexibility and breathability.

The fabric 10, depending on the spacing between the base fabrics 14 and 16, will readily absorb shock placed thereon because of the air spaces between the base fabrics. If it is desired to self contain this fabric the fabric 10 can be encapsulated in a suitable material such as PVC film.

In the preferred form of the invention, the fabric 10 is employed in the sole as well as in the body of the shoe 12. The shoe consists of a rubber-like sole product 20 to which is adhered a fabric 22 which is a thinner version of fabric 10 and which extends around the toe at 24 at one end and up the heel at 26 at the other end. The whole body of the shoe 12 is made from the double plush fabric except in those areas that need additional protection such as the heel 28, the toe 30 and around the opening 32 for the shoe tongue 34. Additionally, a fabric insert 10 conforming to the shape of the inside of the shoe is placed into the bottom of the shoe to provide additional foot support. This fabric is considerably thicker than the fabric 22 to provide a cushion effect to the foot of the wearer. Many types of yarn can be used in the construction of the fabric used in the disclosed shoe construction but preferably nylon or polyester are used to provide the best overall performance.

Obviously, a shoe product has been disclosed which is comfortable to the wearer and provides arch support, breathability and shock absorption qualities not found in comparable shoes.

Although I have described the specific product of my invention it is contemplated that many changes may be made without departing from the scope or spirit of the invention and I desire to be limited only by the scope of the claims.

I claim:

1. An insert for shoes comprising: a relatively flexible and porous double plush warp knit fabric and thermoplastic film material surrounding and encapsulating said fabric.

2. The insert of claim 1 wherein said thermoplastic film is PVC.

3. A shoe comprising: a sole, an upper portion connected to said sole, an opening in said upper portion for the insertion of a foot and an insole insert in said shoe separate from said sole, said insert being a relatively flexible and porous double plush warp knit fabric encapsulated in and surrounded by a thermoplastic film material.

4. The shoe of claim 3 wherein said thermoplastic film is a PVC.

* * * * *